US007331754B2

(12) United States Patent
O'Clair et al.

(10) Patent No.: US 7,331,754 B2
(45) Date of Patent: Feb. 19, 2008

(54) OPTIMIZED NOZZLE BOX STEAM PATH

(75) Inventors: Charles Thomas O'Clair, Waterford, NY (US); Jeyaruban Amirtharajah, Niskayuna, NY (US); Michael Earl Montgomery, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/253,267

(22) Filed: Oct. 18, 2005

(65) Prior Publication Data

US 2007/0086890 A1 Apr. 19, 2007

(51) Int. Cl.
*F01D 9/00* (2006.01)

(52) U.S. Cl. ..... 415/1; 415/185; 415/191; 415/202

(58) Field of Classification Search ..... 415/1, 415/185, 191, 202, 215, 215.1; 137/798
See application file for complete search history.

(56) References Cited

U.S. PATENT DOCUMENTS 5,392,513 A * 2/1995 Mazzola et al. ..... 29/889.1
6,196,793 B1 3/2001 Braaten ..... 415/191
6,754,956 B1 * 6/2004 Tomko et al. ..... 29/889.2

FOREIGN PATENT DOCUMENTS

JP 54044110 A * 4/1979

* cited by examiner

*Primary Examiner*—Ninh H. Nguyen
(74) *Attorney, Agent, or Firm*—Cantor Colburn LLP

(57) ABSTRACT

Disclosed herein is a nozzle box assembly including a torus, a steam path ring, and a bridge ring. The torus has a plurality of steam inlets and an annular steam outlet. The steam path ring has an annular steam inlet, the annular steam inlet has an inner diameter (ID) and an outer diameter (OD), the steam path ring is disposed downstream of the torus. The bridge ring has an annular steam inlet and an annular steam outlet, the annular steam outlet has an ID and an OD, the bridge ring is disposed between the torus and the steam path ring, the bridge ring annular steam outlet is adjacent to the steam path ring annular steam inlet, and the steam path ring annular steam inlet OD is greater than the bridge ring annular steam outlet OD and the steam path ring annular steam inlet ID is smaller than the bridge ring annular steam outlet ID.

10 Claims, 4 Drawing Sheets

OPTIMIZED NOZZLE BOX STEAM PATH

TECHNICAL FIELD

This application relates generally to steam turbines, and more specifically, to a nozzle box for increasing the efficiency of a flow directed to a steam turbine.

BACKGROUND OF THE INVENTION

A nozzle box assembly for a steam turbine generally includes three components: a torus, a bridge ring, and a steam path ring. Each of the components is initially formed in 180° segments, followed by welding the components together to form two nozzle box halves. The halves are then joined together along a horizontal midline to form a steam box assembly for a steam turbine. Each nozzle box half includes one or more steam inlets formed integrally with the torus. These inlets extend from the torus in a plane normal to the axis of rotation of the turbine. During steam turbine operation, the inlets receive steam from a suitable source for flow into the torus. The steam changes direction to a generally axial flow for flow through the annular opening of the bridge ring and into a steam path ring having a series of nozzles which include airfoil vanes for directing the steam flow to subsequent buckets.

Transitions between the torus, bridge ring, and steam path ring along the steam path side disturb the flow of steam from the turbine main steam inlets. This tends to cause turbulence in the steam flow from the main steam inlets as it passes through the bridge ring into the steam path ring, which then causes a loss of efficiency. Reducing the turbulence in the steam path would allow for optimized flow through the nozzle box and increased efficiency of the steam turbine.

BRIEF SUMMARY OF THE INVENTION

Disclosed herein is a nozzle box assembly including a torus, a steam path ring, and a bridge ring. The torus has a plurality of steam inlets and an annular steam outlet. The steam path ring has an annular steam inlet, the annular steam inlet has an inner diameter (ID) and an outer diameter (OD), the steam path ring is disposed downstream of the torus. The bridge ring has an annular steam inlet and an annular steam outlet, the annular steam outlet has an ID and an OD, the bridge ring is disposed between the torus and the steam path ring, the bridge ring annular steam outlet is adjacent to the steam path ring annular steam inlet, and the steam path ring annular steam inlet OD is greater than the bridge ring annular steam outlet OD and the steam path ring annular steam inlet ID is smaller than the bridge ring annular steam outlet ID.

Further disclosed herein is a method for directing steam flow through a nozzle box assembly. The steam flow is conveyed through a torus. And, the steam flow is directed downstream of the torus over a radially outward step.

Yet further disclosed herein is a steam path ring for a nozzle box assembly having a series of nozzles directing steam flow. And, an annular steam inlet, the annular steam inlet having an inner diameter (ID) and an outer diameter (OD), wherein the steam path ring annular steam inlet ID is smaller than a bridge ring annular steam outlet ID and the steam path ring annular steam inlet OD is greater than a bridge ring annular steam outlet OD.

BRIEF DESCRIPTION OF THE DRAWINGS

Referring to the exemplary drawings wherein like elements are numbered alike in the accompanying Figures.

DETAILED DESCRIPTION OF THE INVENTION

Figure 1:
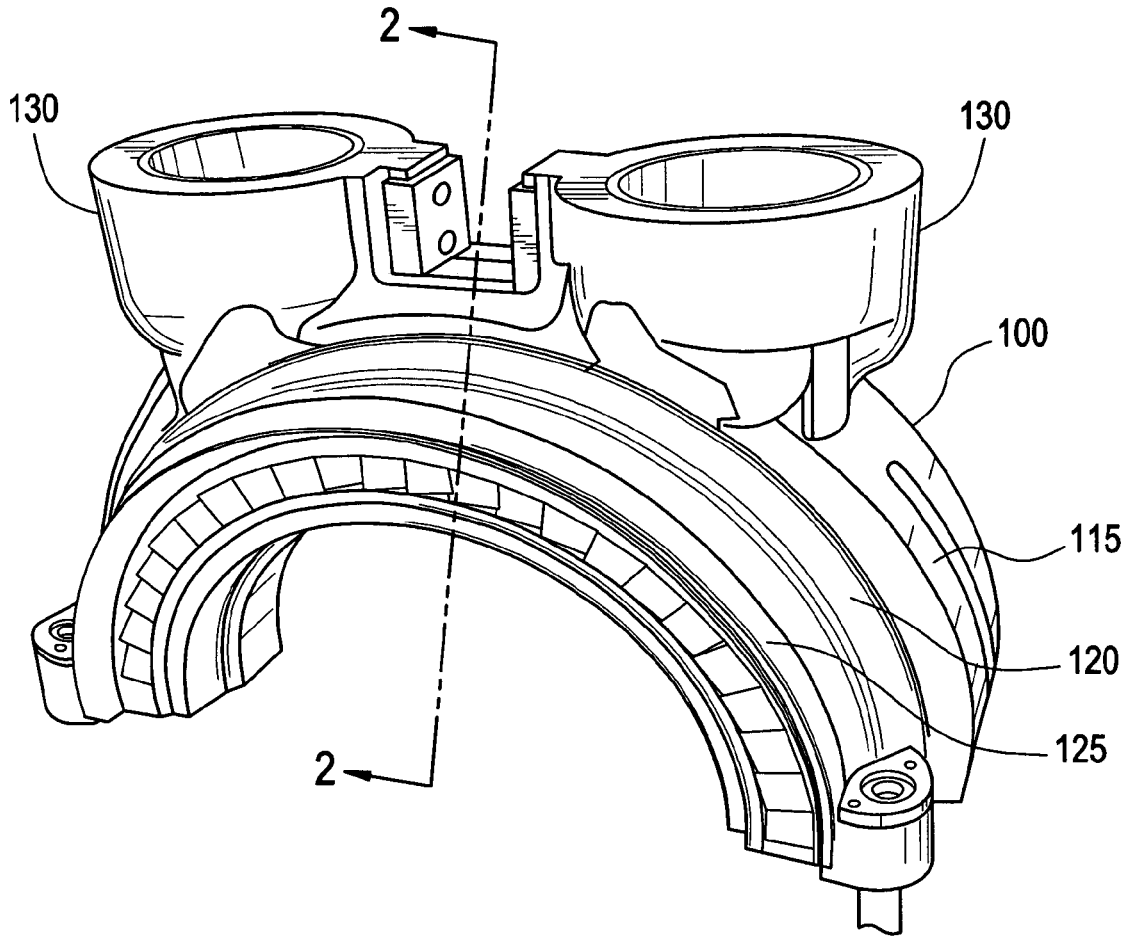
FIG. 1 is a perspective view of one half of an exemplary nozzle box assembly for use in accordance with an embodiment of the invention.

FIG. 1 illustrates an exemplary nozzle box assembly half 100. Each nozzle box assembly half 100 includes a torus 115 portion, a bridge ring 120 portion, and a steam path ring 125 portion. The torus 115, bridge ring 120, and steam path ring 125 portions are joined together to form the nozzle box assembly half 100. Also illustrated are steam inlets 130 forming part of an integral forging with the torus 115. It will be appreciated that in an exemplary full nozzle box assembly, the illustrated nozzle box assembly half 100 is joined with a similar nozzle box assembly half whereby the two nozzle box assembly halves form a complete nozzle box assembly with four steam inlets 130 and the torus 115, the bridge ring 120, and the steam path nozzle ring, in one embodiment, extending a complete 360°.

Figure 2:
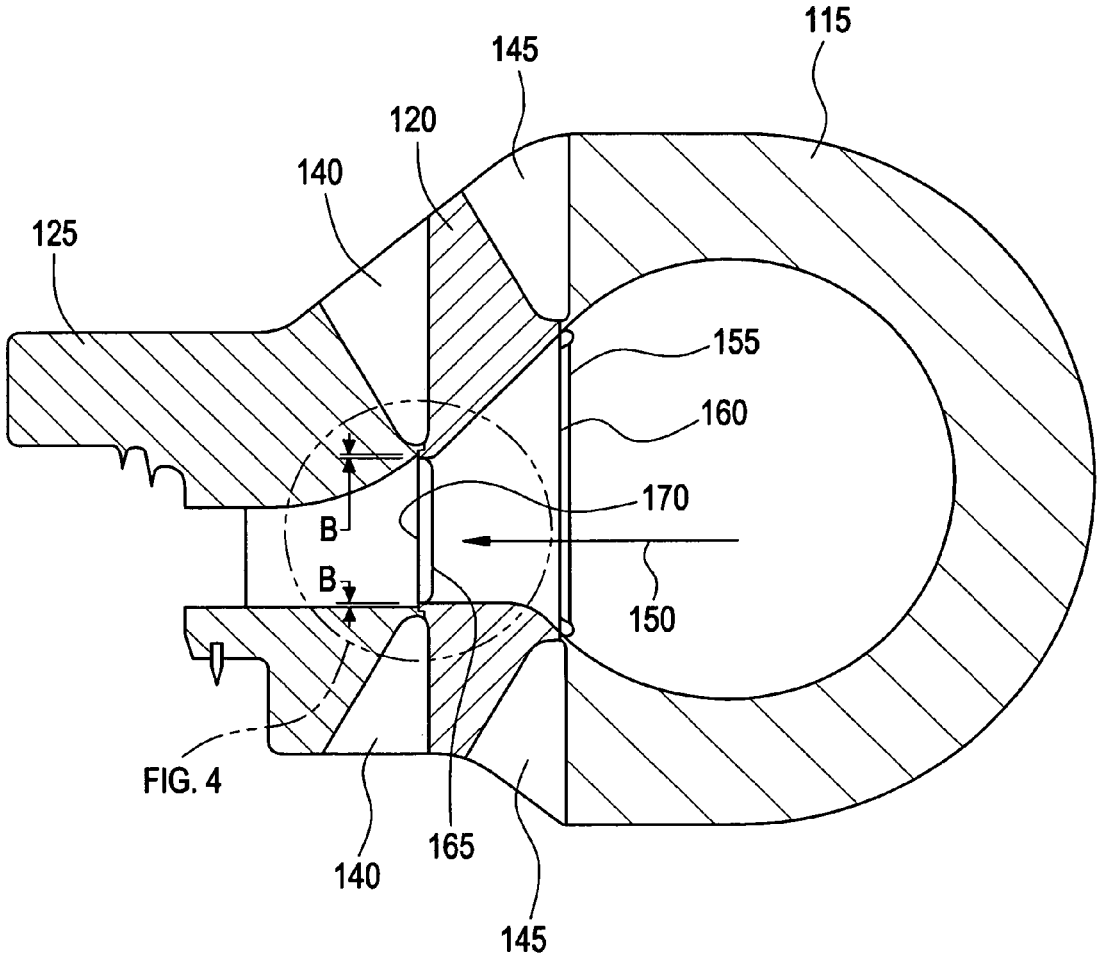
FIG. 2 is a cross section view of the nozzle box assembly of FIG. 1 for use in accordance with an embodiment of the invention.

FIG. 2 illustrates a cross-sectional view of the nozzle box assembly 100 and further depicts the torus 115, the bridge ring 120, and the steam path ring 125. Interface regions 140 and 145, which are located between the steam path ring 125 and the bridge ring 120 and between the bridge ring and the torus 115, respectively, allow for the joining, which may be a weld for example, of the steam path ring 125, the bridge ring 120, and the torus 115 to make one integral nozzle box assembly half 100. The steam flow path through the nozzle box is further depicted by arrow 150. Steam flow through the nozzle box assembly originates in the steam inlets 130 (FIG. 1) which direct the steam flow though the torus 115, then continues through the bridge ring 120, and finally exits the nozzle box assembly through the steam path ring 125 having a series of nozzles which include airfoil vanes for directing the steam flow to subsequent buckets. Mating areas between the torus 115, bridge ring 120, and steam path ring 125 are further depicted and include a torus steam outlet 155, a bridge ring steam inlet 160, a bridge ring steam outlet 165, and a steam path ring steam inlet 170. The torus steam outlet 155, the bridge ring steam inlet 160, the bridge ring steam outlet 165, and the steam path ring steam inlet 170 are annular in shape and provide for a generally axial flow of steam through the nozzle box assembly 100 (FIG. 1).

Figure 3:
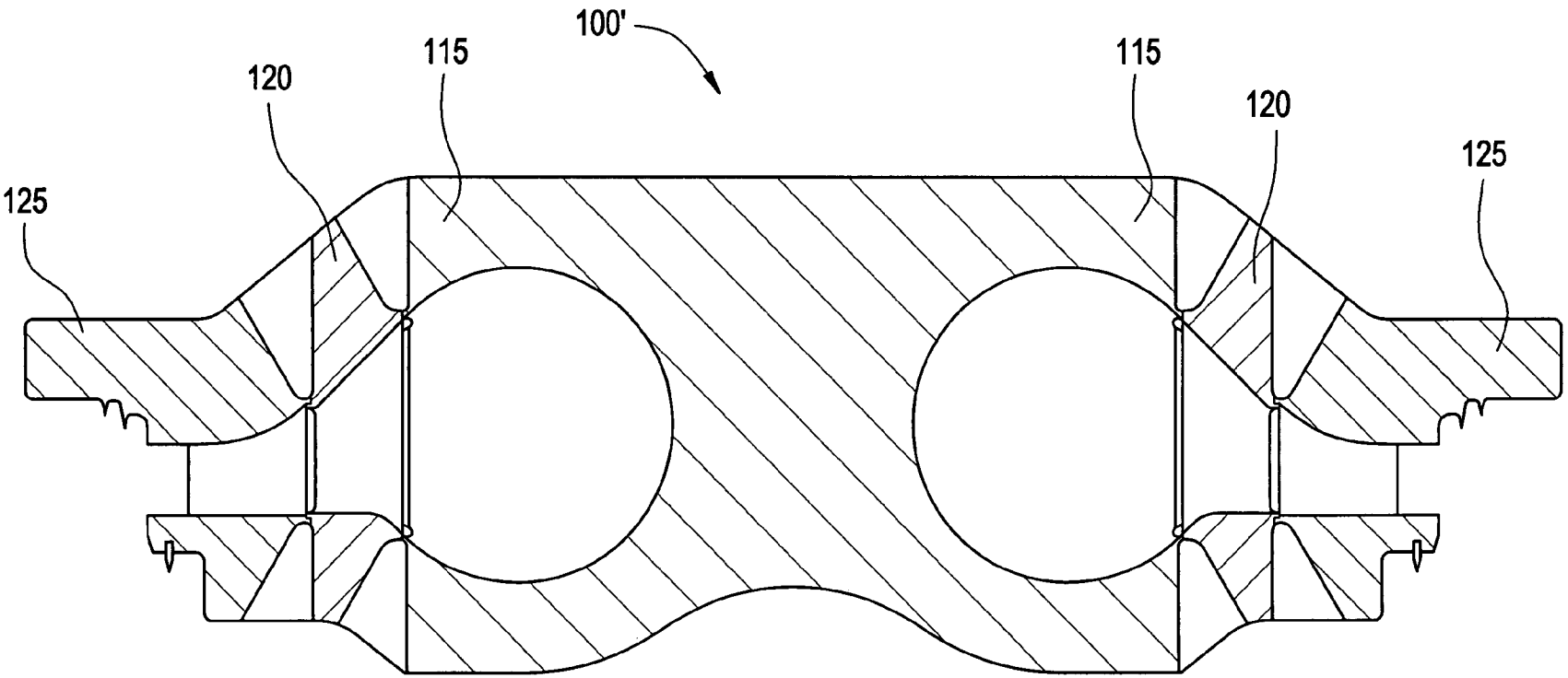
FIG. 3 is a cross section view of a double flow nozzle box assembly for use in accordance with an embodiment of the invention; and, FIG. 4 is an enlarged view of the bridge ring to steam path ring interface of FIG. 2.

Alternatively, as shown in the cross section view of FIG. 3, a double flow nozzle box assembly 100' having two tori 115, two bridge rings 120, and two steam path rings 125 may be employed. The double flow nozzle box 100' shares the same orientation between the torus 115, bridge ring 120, and steam path ring 125 as described previously for the nozzle box assembly 100, but further provides an additional axially opposed arrangement of the torus 115, the bridge ring 120 and the steam path ring 125 to allow for steam flow in both axial directions.

Figure 4:
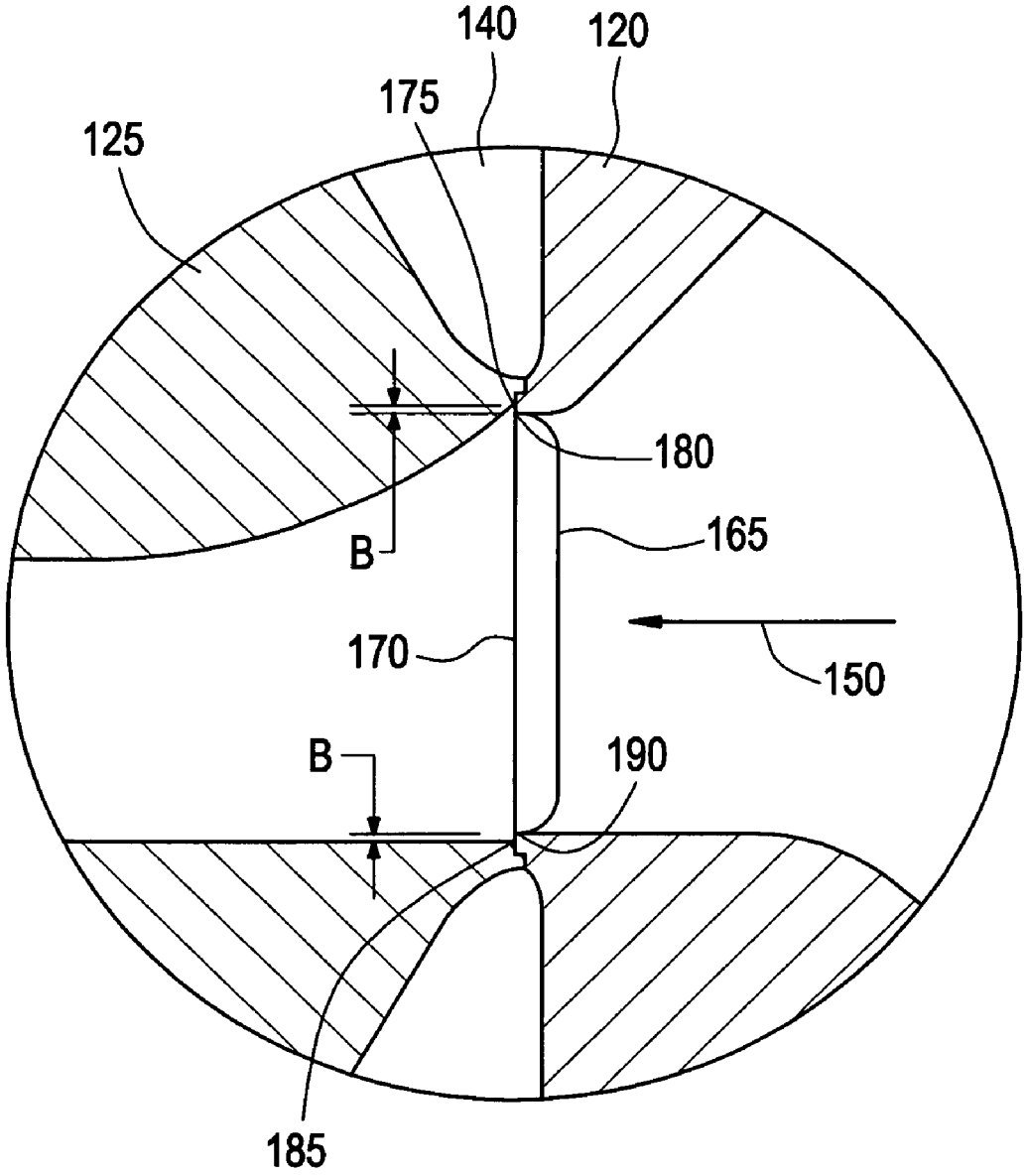

FIG. 4 illustrates an enlarged view of the bridge ring 120 to steam path ring 125 transition which further depicts a steam path ring steam inlet outer diameter (OD) 175, a bridge ring steam outlet OD 180, a steam path ring steam inlet inner diameter (ID) 185, and a bridge ring steam outlet ID 190. A radial step, illustrated at "B", is featured on the steam path side along the bridge ring 120 to steam path ring

125 interface. The radial step, in one embodiment having a preferred dimension of about 0.030 in., but may range between about 0.000 in. and about 0.060 in., creates an increase in cross-sectional area at the transition point between the bridge ring 120 and the steam path ring 125. Different OD's and ID's of the mating steam path ring steam inlet 170 and the bridge ring steam outlet 165 define the radial step. The steam path ring steam inlet OD 175 is greater than the bridge ring steam outlet OD 180 and the steam path ring steam inlet ID 185 is smaller than the bridge ring steam outlet ID 190, therefore resulting in the radial step illustrated at "B". In other words, the radial step may be described as a step in the steam flow path between the bridge ring 120 and the steam path ring 125 wherein the steam path ring steam inlet 170 is larger than the bridge ring steam outlet 165 such that as steam flows along an inner wall of the bridge ring 120, a smooth fluid flow transition occurs along the bridge ring 120 to steam path ring 125 interface due to the increase in cross-sectional area (as opposed to a decrease in cross-sectional area at the interface). The radial step between the steam path ring 125 and the bridge ring 120 provides for a reduction in steam flow turbulence within the nozzle box assembly thus allowing for improved steam turbine efficiency.

In an exemplary embodiment where a welding process is used to join the torus 115, the bridge ring 120, and the steam path ring 125 together, shrinkage, from the welding process, is accounted for in order to preserve the radial step while maintaining 100% welding between the components.

While the invention has been described with reference to a preferred embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What is claimed is:

1. A nozzle box assembly comprising:

a torus having a plurality of steam inlets and an annular steam outlet;

a steam path ring having an annular steam inlet, said annular steam inlet having an inner diameter (ID) and an outer diameter (OD), said steam path ring disposed downstream of said torus; and, a bridge ring having an annular steam inlet and an annular steam outlet, said annular steam outlet having an ID and an OD, said bridge ring disposed between said torus and said steam path ring, said bridge ring annular steam outlet is adjacent to said steam path ring annular steam inlet, wherein said steam path ring annular steam inlet OD is greater than said bridge ring annular steam outlet OD and said steam path ring annular steam inlet ID is smaller than said bridge ring annular steam outlet ID.

2. The nozzle box assembly of claim 1 wherein the difference between said steam path ring and said bridge ring OD's and ID's form a radial step.

3. The nozzle box assembly of claim 2 wherein said radial step is between about 0.000 in. and about 0.060 in.

4. The nozzle box assembly of claim 3 wherein the radial step is about 0.030 inches.

5. The nozzle box assembly of claim 1 wherein the steam path ring and the bridge ring are fixedly joined together.

6. A method for directing steam flow through a nozzle box assembly comprising:

conveying a steam flow through a torus; and, directing the steam flow downstream of said torus over a radially outward step at an interface between a bridge ring and a steam path ring.

7. A steam path ring comprising:

a series of nozzles directing steam flow; and, an annular steam inlet, said annular steam inlet having an inner diameter (ID) and an outer diameter (OD), wherein said steam path ring annular steam inlet ID is smaller than a bridge ring annular steam outlet ID and said steam path ring annular steam inlet OD is greater than a bridge ring annular steam outlet OD.

8. The steam path ring of claim 7 wherein the difference between said steam path ring and said bridge ring OD's and ID's form a radial step.

9. The steam path ring of claim 7 wherein said radial step is between about 0.000 in. and about 0.060 in.

10. The steam path ring of claim 9 wherein said radial step is about 0.030 inches.

* * * * *